US006635980B1

(12) United States Patent
Horiuchi

(10) Patent No.: US 6,635,980 B1
(45) Date of Patent: Oct. 21, 2003

(54) CATHODE-RAY TUBE AND COLOR SELECTION MECHANISM THEREOF

(75) Inventor: Yoshiro Horiuchi, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/453,077

(22) Filed: Dec. 2, 1999

(30) Foreign Application Priority Data

Dec. 3, 1998 (JP) ..... P10-344387

(51) Int. Cl.[7] ..... H01J 29/80
(52) U.S. Cl. ..... 313/407; 313/402; 313/403
(58) Field of Search ..... 313/402, 403, 313/407

(56) References Cited

U.S. PATENT DOCUMENTS

| | | | | | |
|---|---|---|---|---|---|
| 3,737,703 | A | * | 6/1973 | Tsuneta et al. | 313/85 S |
| 4,291,253 | A | * | 9/1981 | Ohkoshi et al. | 313/348 |
| 4,495,437 | A | * | 1/1985 | Kume et al. | 313/403 |
| 4,547,695 | A | * | 10/1985 | Rath | 313/406 |
| 5,550,428 | A | * | 8/1996 | Kume et al. | 313/407 |
| 5,554,909 | A | * | 9/1996 | Brennesholtz | 313/402 |
| 5,576,595 | A | * | 11/1996 | Inoue | 313/402 |
| 5,742,116 | A | * | 4/1998 | Maki et al. | 313/402 |
| 5,751,098 | A | * | 5/1998 | Ito et al. | 313/402 |

FOREIGN PATENT DOCUMENTS

JP 08124493 A * 5/1996 ..... H01J/29/07

OTHER PUBLICATIONS

Sanford I. Heisler, PE, Wiley Engineer's Desk Reference, 1998, John Wiley and Sons, Inc., 2nd edition, pp. 84,85 and 92.*

* cited by examiner

*Primary Examiner*—Ashok Patel
*Assistant Examiner*—Glenn Zimmerman
(74) *Attorney, Agent, or Firm*—Rader, Fishman & Grauer PLLC; Ronald P. Kananen

(57) ABSTRACT

A color selection mechanism of a cathode-ray tube is formed in such a manner that a large number of strip-shaped grid elements are stretched across a frame which has a pair of opposed support members and a pair of elastically-providing members fixed between the support members. In this color selection mechanism, the geometrical moment of inertia of each of the support members can be changed stepwise from a central part of each of the support members to each of end parts thereof by changing a ratio of a longitudinal dimension to a lateral dimension of an L-shaped section of each of the pair of support members stepwise. As a result, it becomes possible to increase the rigidity at the central part of the frame of the color selection mechanism and thereby improve the performance of the color selection mechanism of the cathode-ray tube.

7 Claims, 8 Drawing Sheets

FIG. 11

| | Sectional shape | | Electron beam cut margin [m] | | Geometrical moment of inertia ($mm^4$) | |
|---|---|---|---|---|---|---|
| | End part | Central part | End part | Central part | End part (q) | Central part (p) |
| Present invention | h=20.8mm d=15.2 Thickness =5.0 | h=19.5mm d=17.0 Thickness =5.0 | 1.7mm | 2.3mm | 2600 | 3700 |
| Conventional example | h=22.0mm d=14.5 Thickness=5.0 | | 1.7mm | 4.4mm | 2400 | |

CATHODE-RAY TUBE AND COLOR SELECTION MECHANISM THEREOF

BACKGROUND OF THE INVENTION

1. Field of the Invention

The present invention relates to a color selection mechanism for a color cathode-ray tube used in, for example, color television receivers, display apparatuses and so on.

2. Description of the Related Art

As a color selection mechanism for a color cathode-ray tube, an aperture grille (a color selection called an aperture grille) 30 as shown in FIG. 1 is known.

As for this color selection mechanism 30, there is provided a frame-shaped metal frame 32 which is formed of a pair of opposed support members 37U and 37D and elasticity applying or providing members 38R and 38L extended across the support member 37U to 37D. Between the opposed support members 37U and 37D of this frame 32, there is extended a so-called color selection electrode thin plate 31 having an arrangement including a large number of grid elements 33 and slit-shaped electron beam transmitting holes 35 formed between adjacent grid elements 33.

The support members 37 forming the frame 32 serve as beams for holding the thin plate. The elasticity providing members 38 have a property a spring, and serve as a bow for absorbing plastic deformation caused in the fabrication process of the cathode-ray tube and temporary extension caused by beam irradiation during the operation of the cathode-ray tube. The thin plate needs to have a predetermined tension so as not to cause shaking in the grid elements even for voices from a loudspeaker and an external vibration and shock.

When welding the thin plate to the frame 32, therefore, tension is applied to the thin plate in the extension direction "g" shown in FIG. 1, and compressive force (so-called turnbuckle) is applied to the support members 37U and 37D of the frame 32 conversely in such a direction "h" as to pressurize and compress the space between the support members 37U and 37D.

After such welding is conducted, when the pressurization is removed, the compressive force of the frame 32 is released and the thin plate is fixed to the frame 32 in such a state that tension is always generated in the thin plate. If this tension is low, then the grid elements 33 are vibrated by an external shock, a vibration of the loudspeaker or the like, and consequently the impinging positions of the electron beam thereon are not fixed, resulting in color shifts and disturbed images.

Especially in such a frame that joint points of the support members 37 and the elasticity providing members 38 are selected at the ends of the support members 37, deflection at the central part of the support members 37 becomes large and hence a predetermined tension cannot be ensured, resulting in a problem.

As shown in FIG. 2A, the frame 32 of the color selection mechanism 30 has an L-shaped section. The frame 32 has such a shape that a longitudinal length "h" and a lateral length "d" of the L shape are the same in both its central part and end parts. The position and thickness of the frame 32 are determined so as to minimize an interference margin distance "m" between an end part 37*d* of the support 37 and an electron beam E.

For pressurizing the frame 32 and obtaining a predetermined tension distribution over the whole surface of the thin plate, the support members 37 must be tough, and increased weight of the frame 32 poses a problem. Therefore, attempts to increase the mechanical strength (geometrical moment of inertia) has been made. For example, the plate thickness of the support members 37 is increased while maintaining margin distance "mc" and "me" for the electron beam E. Furthermore, the dimension of the L shape as a whole is increased by suitably selecting the horizontal/lateral ratio h/d of the dimension of the L shape as shown in FIG. 2B (although the horizontal/lateral ratio h/d is constant in the range from the end parts to the central part), or the like.

Since the conventional support members 37 are shaped so that the end parts and the central part will have the same sectional shape (i.e., the same longitudinal/lateral ratio of the dimension of the L shape), however, the mechanical strength is determined on only the plate thickness from the problem of the electron beam cut, and consequently the degree of freedom of the design is low.

Especially, in a frame for a large sized tube, the weight becomes extremely large. The increased frame weight not only increases the cost but also aggravates the shock resistance of the cathode-ray tube. In addition, it is necessary to prepare various kinds of plate thickness of the frame material according to predetermined strength values of model units, and hence it is difficult to decrease the stock of materials.

Furthermore, in the above described improvement method, fabrication is difficult and the cost increases significantly. For its application to a general purpose cathode-ray tube; therefore, there are many problems.

SUMMARY OF THE INVENTION

In view of the above described points, an object of the present invention is to provide a cathode-ray tube and its color selection mechanism having an excellent quality and improved in mechanical strength without being increased in weight by improving the shape of the support members.

According to a color selection mechanism of the cathode-ray tube of the present invention, a geometrical moment of inertia representing the mechanical strength of a frame can be freely set by changing a ratio of a longitudinal dimension to a lateral dimension of an L-shaped section of each support member stepwise from a central part of each support member to each of end parts thereof without changing the whole width of the L-shaped section.

According to the color selection mechanism of the present invention, it becomes possible to increase the mechanical strength of the frame by using a single material without increasing the weight of the support member. In particular, it becomes possible to improve the shock resistance of a large-sized cathode-ray tube. And it becomes possible to reduce the manufacturing cost thereof.

According to a cathode-ray tube of the present invention, there is provided a color selection mechanism in which a ratio of a longitudinal dimension to a lateral dimension of an L-shaped section of each of a pair of support members is changed stepwise from a central part of each of the pair of support members to end parts thereof. As a result, it becomes possible to increase the mechanical strength of the central part of the support members without increasing the weight of the frame itself. Since the tension of the central part of the color selection electrode thin plate can be increased, the shock resistance of the cathode-ray tube can be prevented from being aggravated by an increase of the frame weight.

BRIEF DESCRIPTION OF THE DRAWINGS

FIG. 11 is example of the support member of the present invention.

DETAILED DESCRIPTION OF THE PREFERRED EMBODIMENT

A color selection mechanism of a cathode-ray tube in accordance with the present invention includes a frame having a pair of opposed support members and a pair of elasticity applying or providing members fixed between the support members and a large number of strip-shaped grid elements stretched across the frame, in which a geometrical moment of inertia of each of the support members is changed stepwise from a central part of each of the support members to end parts thereof by changing a ratio of a longitudinal dimension to a lateral dimension of an L-shaped section of each of the pair of support members stepwise.

In the color selection mechanism of a cathode-ray tube according to the present invention, a ratio (p/q) of a geometrical moment of inertia "p" at the central part of each of the support members to a geometrical moment of the inertia "q" at each of end parts thereof is set equal to or larger than 1.1.

In the color selection mechanism of a cathode-ray tube according to the present invention, the support members are formed by press molding working.

A cathode-ray tube in accordance with the present invention has a color selection mechanism in which a ratio of a longitudinal dimension to a lateral dimension of an L-shaped section of each of the pair of support members is changed stepwise from a central part of each of the pair of support members to each of end parts thereof.

An embodiment of a color selection mechanism of a cathode-ray tube according to the present invention will be described with reference to the attached drawings.

Figure 1:
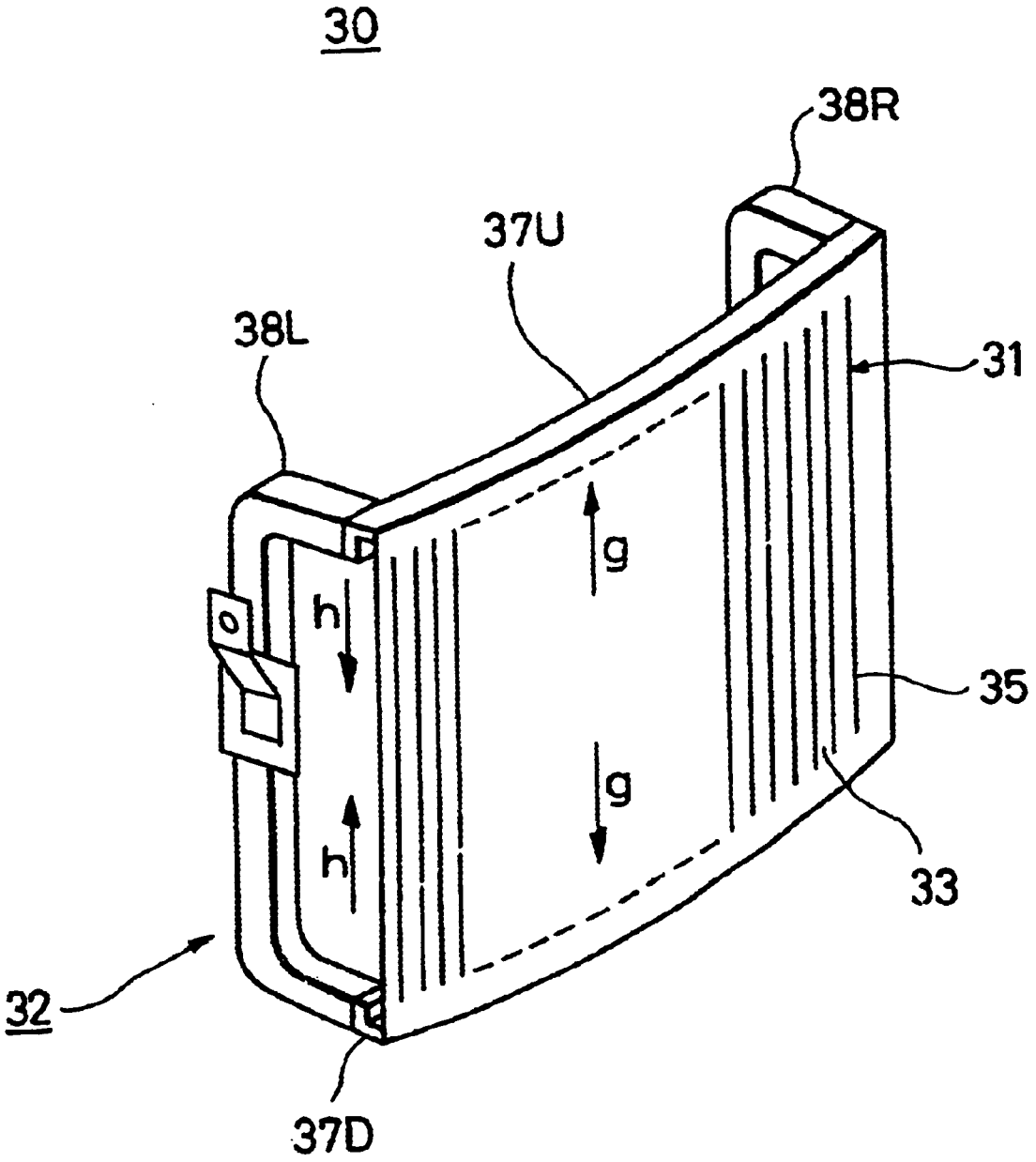
FIG. 1 PRIOR ART
FIG. 1 is a perspective view of a conventional color selection mechanism.
Figure 2A:
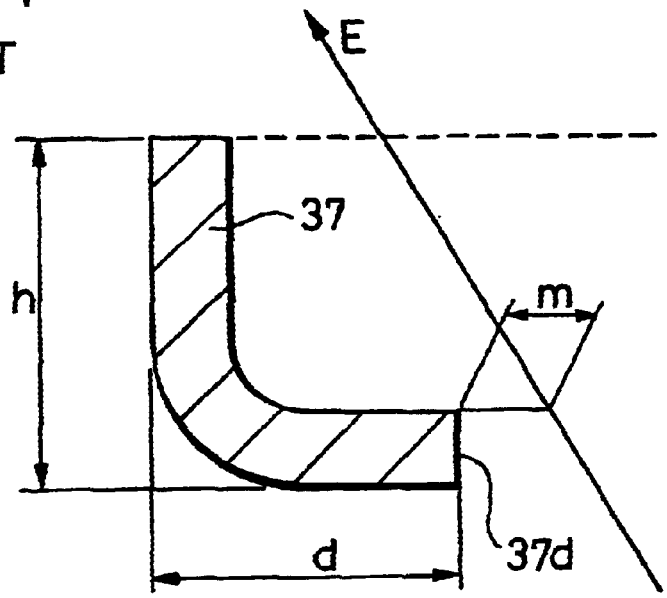
FIG. 2A PRIOR ART
FIGS. 2A and 2B are respectively diagrams for explanation of a section of a conventional support member.
Figure 2B:
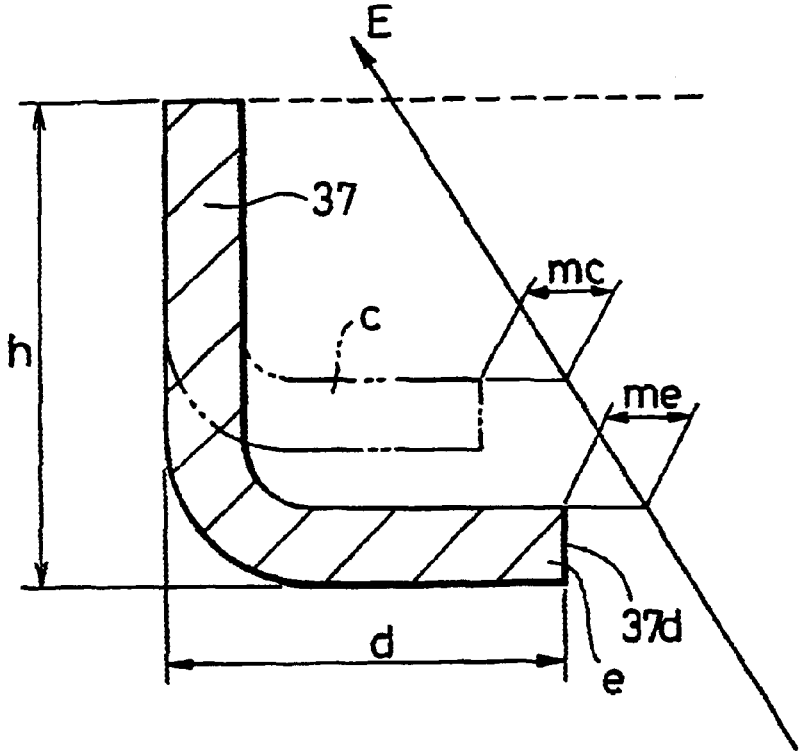
FIG. 2B PRIOR ART
Figure 3:
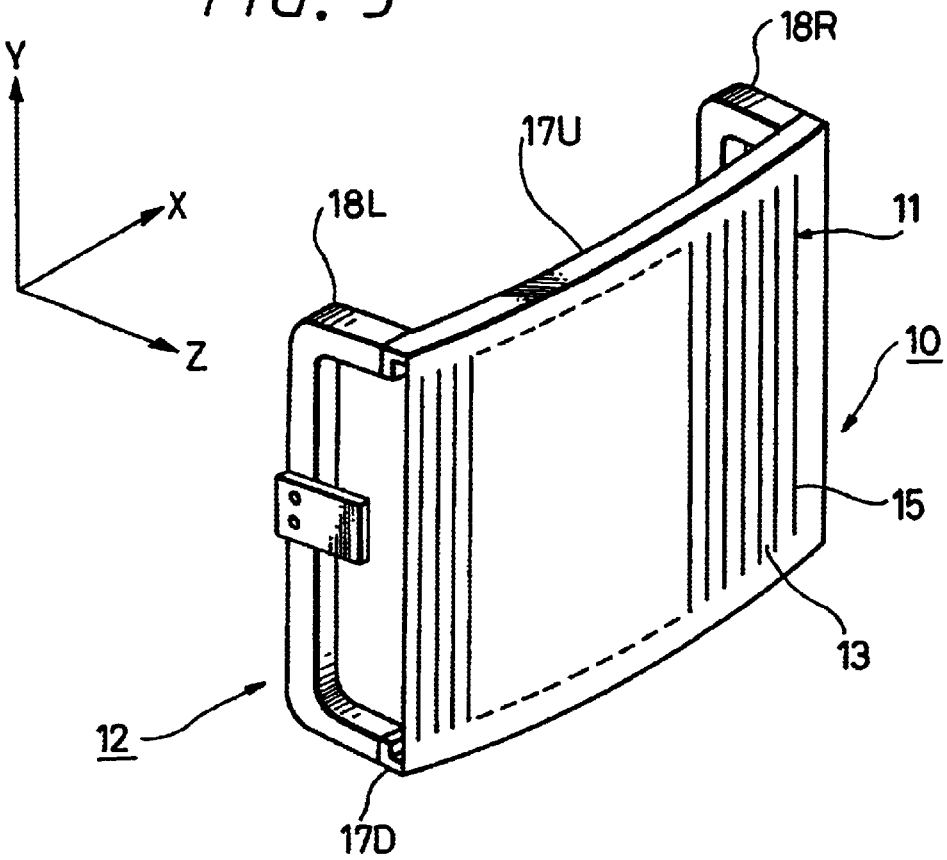
FIG. 3 is a perspective view of an embodiment of a color selection mechanism according to the present invention.
Figure 4:
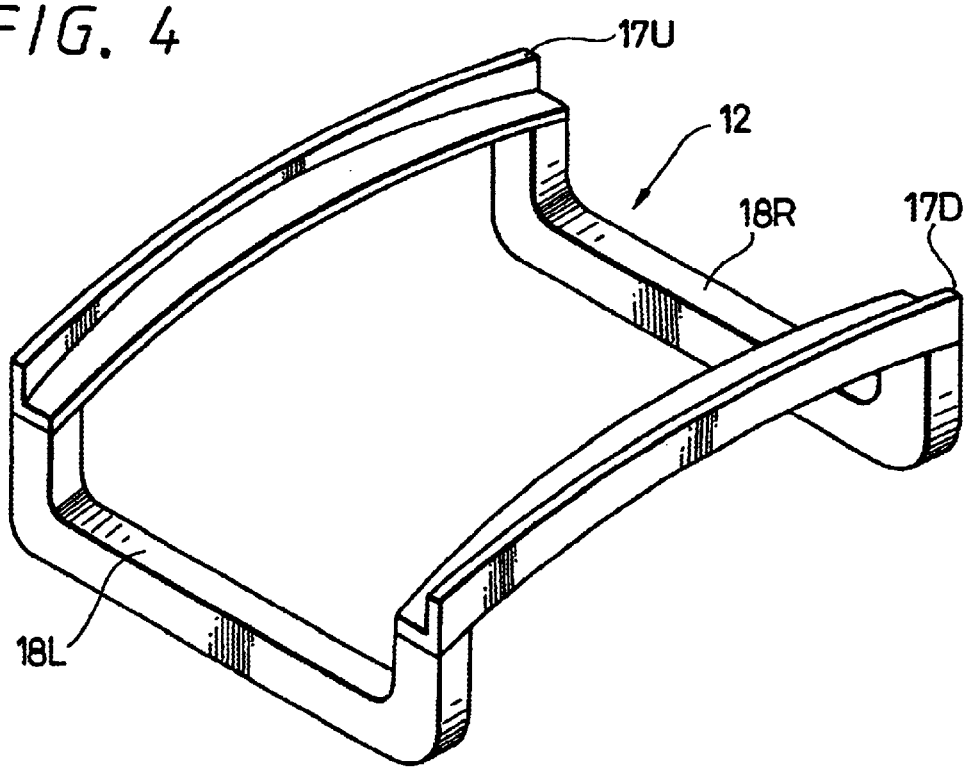
FIG. 4 is a perspective view of a frame according to the present invention.

FIG. 3 shows a schematic configuration of a whole color selection mechanism 10 called an aperture grille according to the present embodiment, and FIG. 4 is a schematic perspective view of a frame 12 before welding a color selection electrode thin plate 11 to this color selection mechanism 10.

This color selection mechanism 10 has a frame-shaped metal frame 12 formed of a pair of opposed support members 17U and 17D and elasticity applying or providing members 18R and 18L stretched between the support members 17U and 17D. Between the opposed support members 17U and 17D of this frame 12, there is extended or stretched the color selection electrode thin plate 11 having an arrangement including a large number of grid elements 13 and slit-shaped electron beam transmitting apertures or holes 15 formed between adjacent grid elements 13.

Figure 5:
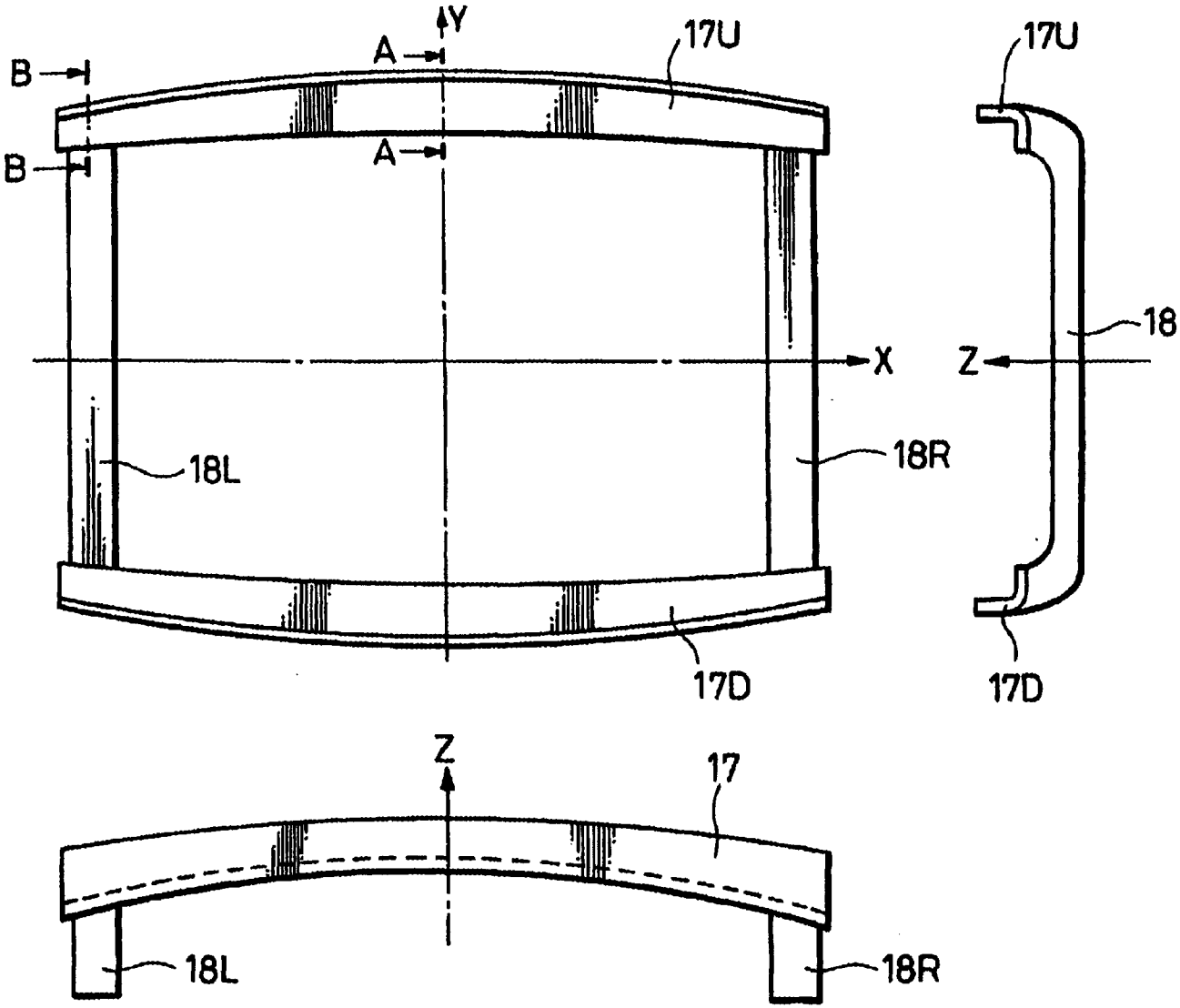
FIG. 5 is a configuration diagram of the frame according to the present invention.
Figure 6A:
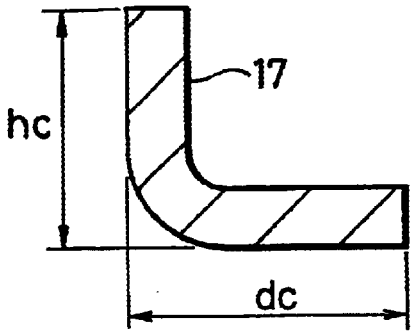
FIG. 6A is a sectional view of a support member of FIG. 5 taken along a section A—A.
Figure 6B:
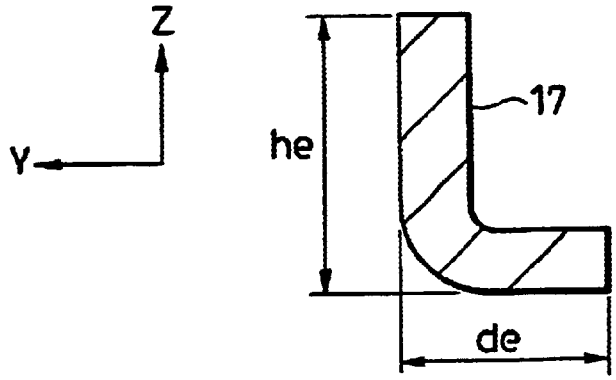
FIG. 6B is a sectional view of a support member of FIG. 5 taken along a section B—B.

FIG. 5 shows a configuration of the frame 12 of the above described color selection mechanism 10. FIGS. 6A and 6B schematically show shapes of the support member 17 of FIG. 5 taken along a section A—A (central part) and a section B—B (end part), respectively.

In the present embodiment, the ratio (h/d) of the longitudinal dimension "h" of the sectional shape of the support member 17 to the lateral dimension "d" thereof as shown in FIGS. 6A and 6B is changed stepwise from the central part to the end part. The longitudinal dimension is set so as to satisfy the relation hc<he.. The lateral dimension is set so as to satisfy the relation dc>de.

As described, both the end parts and the central part can be manufactured with the same belt (steel plate) width by press molding working. As occasion demands, however, it is also possible to punch out a part of the steel plate so that the central part will have a broader width than the end parts stepwise and thereby further increase the geometrical moment of inertia of the central part.

Figure 7:
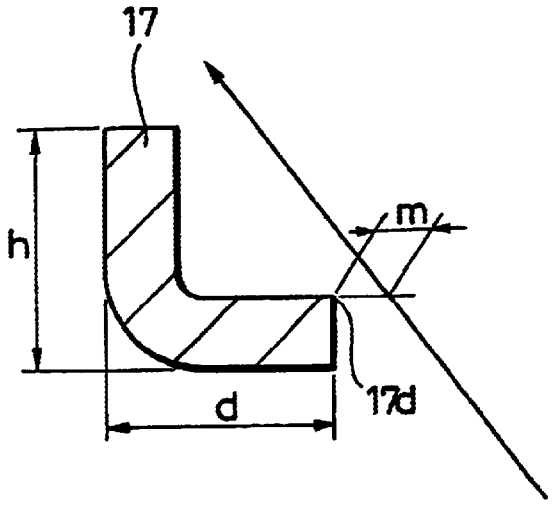
FIG. 7 is a diagram showing a relation between an electron beam and a support member.

The shapes of the support member 17 at the end part and the central part, i.e., he/de and hc/dc can be suitably designed so as not to cut an electron beam E and so as to ensure a predetermined margin distance m from a member end 17d of the support member 17 as shown in FIG. 7.

Furthermore, in the present embodiment, the ratio (p/q) of the geometrical moment of inertia "p" at the central part of the support member 17 to the geometrical moment of inertia "q" at the end part thereof is set equal to or larger than 1.1, preferably equal to or larger than 1.2.

By changing the sectional shape (h/d) of the support member 17 stepwise from the central part to the end part, the geometrical moment of inertia also changes stepwise according to the sectional shape of the support member 17.

In such a color selection mechanism 10 of the present embodiment, the support member 17 of the frame 12 can be manufactured as hereafter described.

Figure 8A:
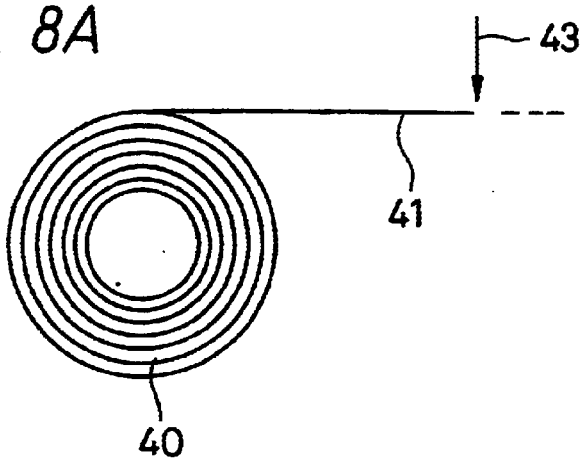
FIG. 8A is a former process diagram of the support member according to the present invention.
Figure 8A:
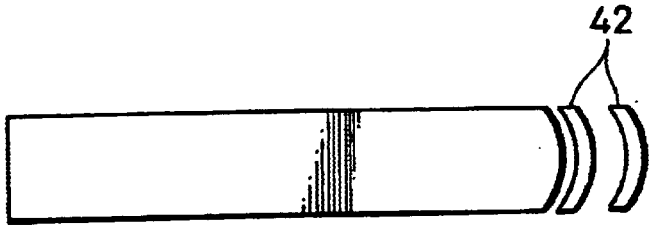

First of all, as shown in FIG. 8A, a steel plate 41 fed from a steel plate coil 40 is subjected to press cut 43, whereby a strip-shaped steel piece 42 is obtained.

Figure 8B:
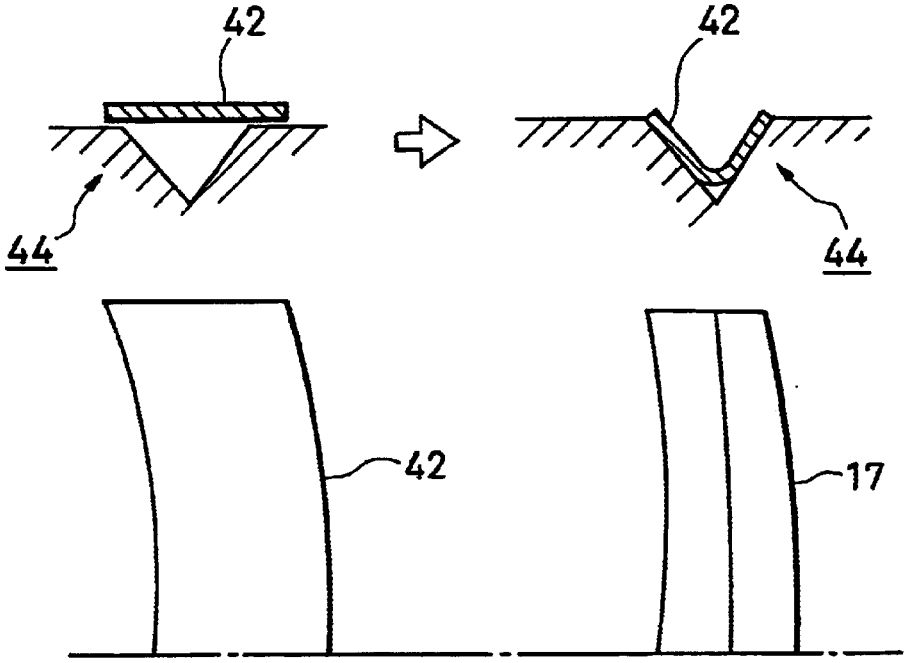
FIG. 8B is a latter process diagram of the support member according to the present invention.
Figure 9:
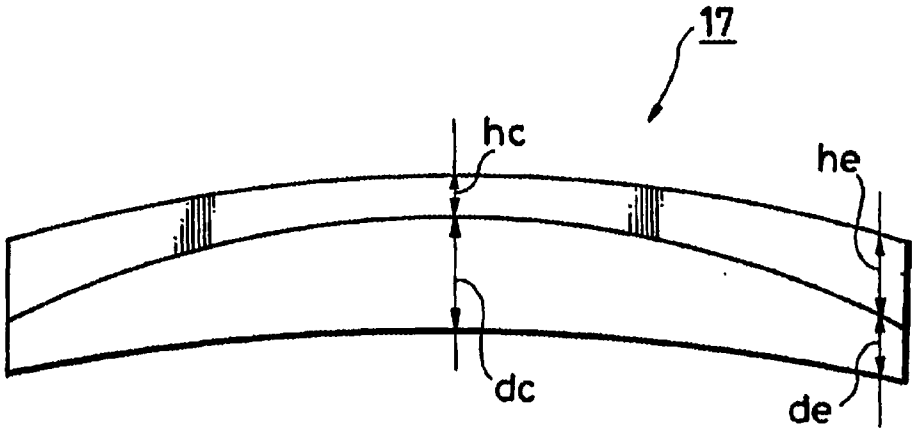
FIG. 9 is a development of a support member according to the present invention.

Subsequently, the steel piece 42 is pressed so as to have a predetermined shape as shown in FIG. 8B by using a V-shaped bending machine 44. As a result, an L-shaped support member 17 is obtained. FIG. 9 is a development for showing the ratio of the longitudinal dimension to the lateral dimension at a first end part, a central part, and a second end part of the L-shaped support member 17. FIG. 9 shows a case where the whole width at the end parts is equal to that at the central part.

The sectional shapes of a first end part, a central part, and a second end part of the L-shaped support member 17 (he/de, hc/dc and he/de) can be freely selected by setting a die punch and a base of the V-shaped bending machine 44 to be predetermined shapes.

An example of the support member 17 of the present invention thus obtained for the case of a cathode-ray tube of 17 inch type is shown in TABLE 1 and FIG. 11.

TABLE 1

| | Sectional shape | |
|---|---|---|
| | End part | Central part |
| Present invention | h = 20.8 mm<br>d = 15.2<br>Thickness = 5.0 | h = 19.5 mm<br>d = 17.0<br>Thickness = 5.0 |
| Conventional example | h = 22.0 mm<br>d = 14.5<br>Thickness = 5.0 | |
| | **Electron beam cut margin [m]** | |
| | End part | Central part |
| Present invention | 1.7 mm | 2.3 mm |
| Conventional example | 1.7 mm | 4.4 mm |
| | **Geometrical moment of inertia ($mm^4$)** | |
| | End part (q) | Central part (p) |
| Present invention | 2600 | 3700 |
| Conventional example | 2400 | |

When the longitudinal dimension, the lateral dimension and the thickness of sectional shape of the support member are given as shown in the figure below, respectively, the geometric moments of inertia (I) is calculated as below:

$e_2=(d_1h_1^2+d_2h_2^2)/2*(d_1h_1+d_2h_2)$ $e_1=h_2-e_2$ $I=d_2(e_1^3+e_2^3)/3+d_1h_1(e_2-h_1/2)+d_1h_1^3/12$

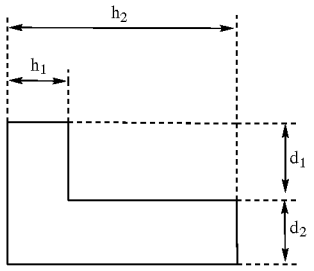

In the case of the present invention shown in an upper row, the ratio (p/q) of the geometrical moment of inertia "p" at the central part to the geometrical moment of inertia "q" at the end part is approximately 1.42. In the conventional method, sections are the same and consequently p/q becomes 1.

Furthermore, by regarding the grid element 13 as a chord, the tension applied to the grid element 13 in each position of the color selection electrode thin plate 11 of the color selection mechanism (AG) 10 after graphitization processing is typically represented indirectly by its resonance frequency with the following expression 1 taken as a reference.

$$f = \frac{1}{2L}\sqrt{\frac{TG}{p}} \qquad \text{[Expression 1]}$$

f frequency of chord (Hz)

ρ linear density of chord (gr/cm)

L length of chord (cm)

G acceleration of gravity ($cm/s^2$)

T tension of chord (gr)

Figure 10:
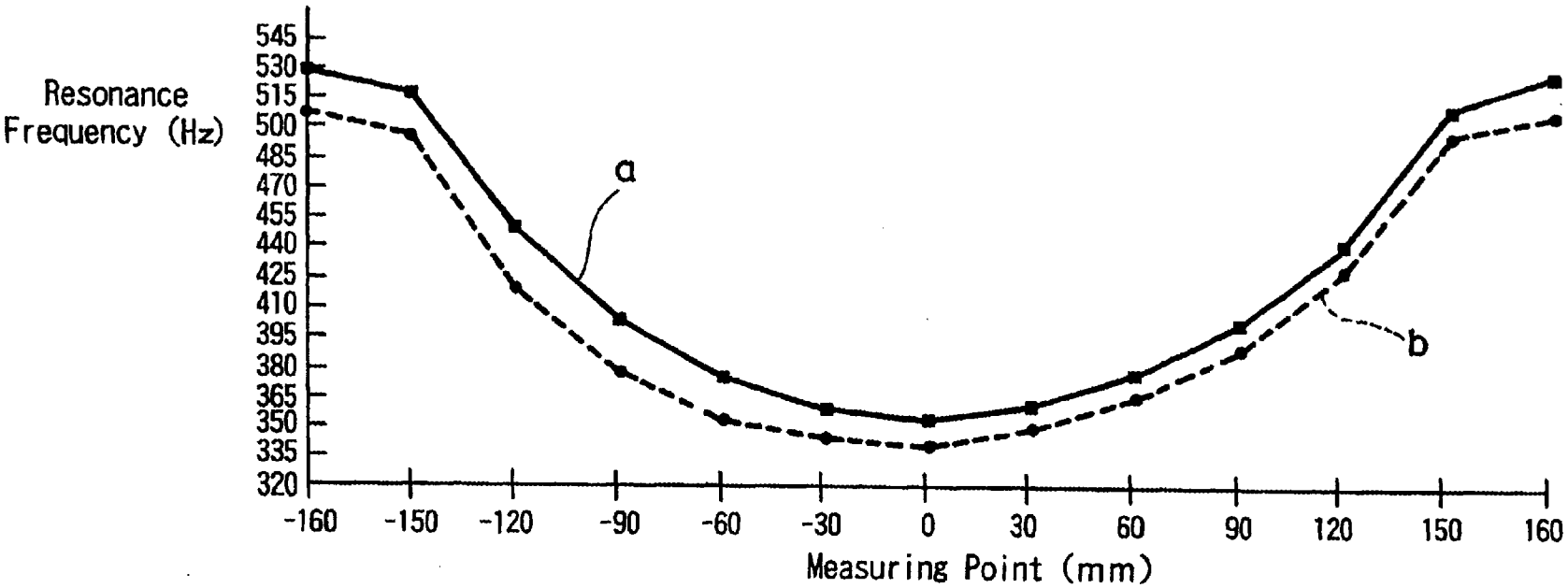
FIG. 10 is a tension distribution diagram of a color selection electrode thin plate according to the present invention after graphitization processing.

Resonance frequency at each of points in the range from the first end to the second end through the central part of the support member 17 is shown in FIG. 10. In comparison with the color selection mechanism 10 of the present invention (solid line "a"), the case where the conventional color selection mechanism 30 (broken line "b") is used is also shown.

According to the present embodiment, the geometrical moment of inertia indicating the mechanical strength of the frame 12 can be freely set by changing the ratio of the longitudinal dimension to the lateral dimension of the L-shaped section between the end part and the central part of the support member 17 stepwise.

Without making the weight of the frame 12 itself heavy, therefore, it becomes possible to increase the mechanical strength at the central part and increase the tension at the central part of the color selection electrode thin plate 11. As a result, it becomes possible to prevent the shock resistance of the cathode-ray tube from being aggravated by an increase of the weight of the frame 12.

In addition, the support members are obtained by punching out a steel plate serving as a material of the support members with the same width and pressing. The punching out in the press can be conducted without a waste. Therefore, an increase of the material cost is avoided. Furthermore, since it becomes unnecessary to prepare the frame material for each of the model units, it also becomes possible to decrease the stock of the material.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A color selection mechanism of a cathode-ray tube, comprising:

a frame having a pair of opposed support members and a pair of elasticity providing members fixed between said support members; and a large number of strip-shaped grid elements stretched across said frame, wherein a geometrical moment of inertia of each of said support members is changed stepwise from a central part of each of said support members to each of end parts thereof by changing a ratio of a longitudinal dimension to a lateral dimension of an L-shaped section of each of said pair of support members stepwise, and wherein a ratio (p/q) of a geometrical moment of inertia "p" at the central part of each of said support members to a geometrical moment of inertia "q" at each of end parts thereof is set equal to or larger than 1.1.

2. A color selection mechanism of a cathode-ray tube, comprising:

a frame, said frame including a plurality of support members, each support member of said plurality of support members having a cross section, a central portion and a distal end portion, said cross section having a first projection and a second projection, said first projection and said second projection intersecting at a vertex, said central portion being proximately central to a support member length of said each support member, said first projection at said central portion having a length "hc", said second projection at said central portion having a length "dc", said distal end portion being at a distal end of said support member length, said first projection at said distal end portion having a length "he", said second projection at said distal end portion having a length "de", wherein hc/dc≠he/de and dc>de.

3. A color selection mechanism of a cathode-ray tube according to claim 2, wherein hc<he.

4. A color selection mechanism of a cathode-ray tube, comprising:

a frame, said frame including a plurality of support members, each support member of said plurality of support members having a cross section, a central portion and a distal end portion, said cross section having a first projection and a second projection, said first projection and said second projection intersecting at a vertex, said central portion being proximately central to a support member length of said each support member, said first projection at said central portion having a length "hc", said second projection at said central portion having a length "dc", said distal end portion being at a distal end of said support member length, said first projection at said distal end portion having a length "he", said second projection at said distal end portion having a length "de", wherein hc/dc≠he/de, wherein said central portion has a geometrical moment of inertia "p", and said distal end portion has a geometrical moment of inertia "q", wherein 1.1≦p/q.

5. A cathode-ray tube, comprising:

a color selection mechanism, said color selection mechanism including a frame, said frame having a plurality of support members, each support member of said plurality of support members having a cross section, a central portion and a distal end portion, said cross section having a first projection and a second projection, said first projection and said second projection intersecting at a vertex, said central portion being proximately central to a support member length of said each support member, said first projection at said central portion having a length "hc", said second projection at said central portion having a length "dc", said distal end portion being at a distal end of said support member length, said first projection at said distal end portion having a length "he", said second projection at said distal end portion having a length "de", wherein hc/dc≠he/de and dc>de.

6. A cathode-ray tube according to claim 5, wherein hc<he.

7. A cathode-ray tube, comprising:

a color selection mechanism, said color selection mechanism including a frame, said frame having a plurality of support members, each support member of said plurality of support members having a cross section, a central portion and a distal end portion, said cross section having a first projection and a second projection, said first projection and said second projection intersecting at a vertex, said central portion being proximately central to a support member length of said each support member, said first projection at said central portion having a length "hc", said second projection at said central portion having a length "dc", said distal end portion being at a distal end of said support member length, said first projection at said distal end portion having a length "he", said second projection at said distal end portion having a length "de", wherein hc/dc≠he/de, wherein said central portion has a geometrical moment of inertia "p", and said distal end portion has a geometrical moment of inertia "q", wherein 1.1≦p/q.

* * * * *